US006952184B2

(12) United States Patent
Sievenpiper et al.

(10) Patent No.: US 6,952,184 B2
(45) Date of Patent: Oct. 4, 2005

(54) CIRCULARLY POLARIZED ANTENNA HAVING IMPROVED AXIAL RATIO

(75) Inventors: Daniel Frederic Sievenpiper, Los Angeles, CA (US); James H. Schaffner, Chatsworth, CA (US); Julio A. Navarro, Kent, WA (US)

(73) Assignee: The Boeing Company, Chicago, IL (US)

( * ) Notice: Subject to any disclaimer, the term of this patent is extended or adjusted under 35 U.S.C. 154(b) by 65 days.

(21) Appl. No.: 10/628,019

(22) Filed: Jul. 25, 2003

(65) Prior Publication Data

US 2005/0017919 A1 Jan. 27, 2005

(51) Int. Cl.[7] ..... H01Q 1/38
(52) U.S. Cl. ..... 343/700 MS; 343/824; 343/910
(58) Field of Search ..... 343/700 MS, 776, 343/795, 824, 909, 910, 911 R

(56) References Cited

U.S. PATENT DOCUMENTS 6,529,166 B2 * 3/2003 Kanamaluru ..... 343/700 MS

OTHER PUBLICATIONS

D. Sievenpiper, J. Schaffner and J. Navarro, "Axial ratio improvement in aperture antennas using high–impedance ground plane," Electronics Letters, Nov. 7, 2002, vol. 38, No. 23, pp. 1411–1412.

* cited by examiner

*Primary Examiner*—Shih-Chao Chen
(74) *Attorney, Agent, or Firm*—Gates & Cooper LLP

(57) ABSTRACT

A circularly polarized antenna system having improved axial ratio is disclosed. The antenna system comprises a circularly-polarized antenna, and a high-impedance buffer surface, surrounding the circularly polarized antenna, and disposed between the circularly polarized antenna and a ground plane. The width of the high-impedance buffer surface between the circularly-polarized antenna and the ground plane is selected to achieve an H-plane radiation pattern substantially identical to an E-plane radiation pattern over a desired scan angle.

20 Claims, 10 Drawing Sheets

CIRCULARLY POLARIZED ANTENNA HAVING IMPROVED AXIAL RATIO

BACKGROUND OF THE INVENTION

1. Field of the Invention

The present invention relates to systems and methods for transmitting and/or receiving electromagnetic signals, and in particular to a circularly polarized antenna having an improved axial ratio characteristic.

2. Description of the Related Art

Circularly polarized antennas are used in a variety of applications, including communications between vehicles with metallic structures such as aircraft and spacecraft, and terrestrial assets. Circular polarization is also used in satellite communication antennas because it allows the receiver on the ground to be in any orientation with respect to the satellite without incurring polarization mismatch. It also allows twice the data rate to be used sent using the same bandwidth, because two different data streams can be sent on left and right hand circular polarization.

However, for effective transmission and reception of such circularly polarized signals, the antennas on both the satellite and the ground or air station must have low axial ratio (ratio of the major axis to the minor axis of the polarization ellipse), in order to preserve the polarization purity between the two components (left and right hand polarizations), and minimize interference between the two.

What is needed is a circularly polarized antenna that provides a low axial ratio. The present invention satisfies that need.

SUMMARY OF THE INVENTION

To address the requirements described above, the present invention discloses a circularly polarized antenna system. The antenna system comprises a circularly-polarized antenna, and a high-impedance buffer surface, surrounding the circularly polarized antenna, and disposed between the circularly polarized antenna and a ground plane. The width of the high-impedance buffer surface between the circularly-polarized antenna and the ground plane is selected to achieve an H-plane radiation pattern substantially identical to an E-plane radiation pattern over a desired scan angle.

BRIEF DESCRIPTION OF THE DRAWINGS

Referring now to the drawings in which like reference numbers represent corresponding parts throughout.

DETAILED DESCRIPTION OF PREFERRED EMBODIMENTS

Figure 1A:
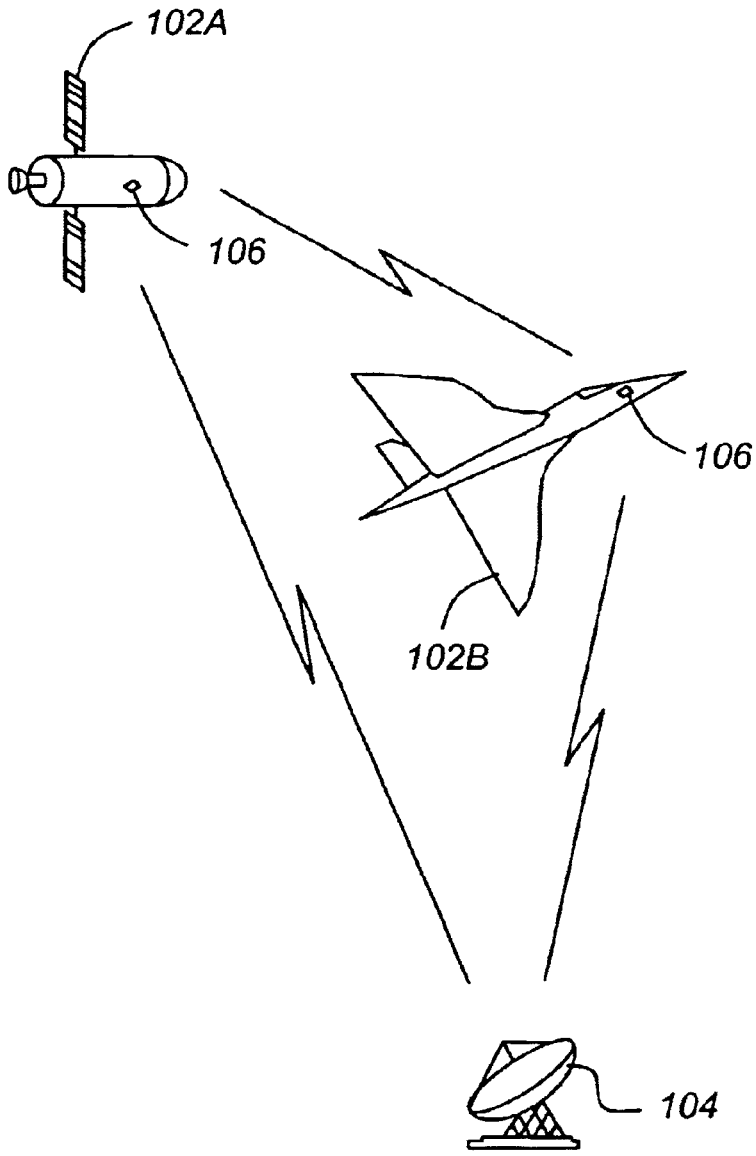
FIG. 1A is a diagram depicting communications among a spacecraft, an aircraft, and a terrestrial asset.

In the following description, reference is made to the accompanying drawings which form a part hereof, and which is shown, by way of illustration, several embodiments of the present invention. It is understood that other embodiments may be utilized and structural changes may be made without departing from the scope of the present invention. FIG. 1A is a diagram depicting communications between a first entity 102 such as a spacecraft 102A or an aircraft 102B and a terrestrial entity 104 such as a ground station using a circularly polarized antenna system 106.

Circularly polarized antenna systems 106 typically transmit signal components that are both right hand circularly polarized, and left hand circularly polarized. If these components are sufficiently isolated, both can be used, providing two channels that can be used effectively doubling the data rate of the communication link by transmitting two different data streams, one on each polarization. If the components are not sufficiently isolated, isolation of each of the two channels becomes more difficult. Also, typically, the axial ratio of a circularly polarized antenna degrades as lower angles (look angles closer to the ground plane of the antenna). For example, in communications between an aircraft 102B and a spacecraft 102A, such as a satellite, the circularly polarized antenna system 106 is required to steer the beam towards the satellite, which, depending on the attitude of the aircraft 102B, is often at low scan angles (shown in FIG. 1C as 120) with respect to the ground plane.

Conventionally, circularly polarized antenna systems 106 on ordinary metal ground planes tend to suffer from poor axial ratio at angles near the ground plane.

Figure 1B:
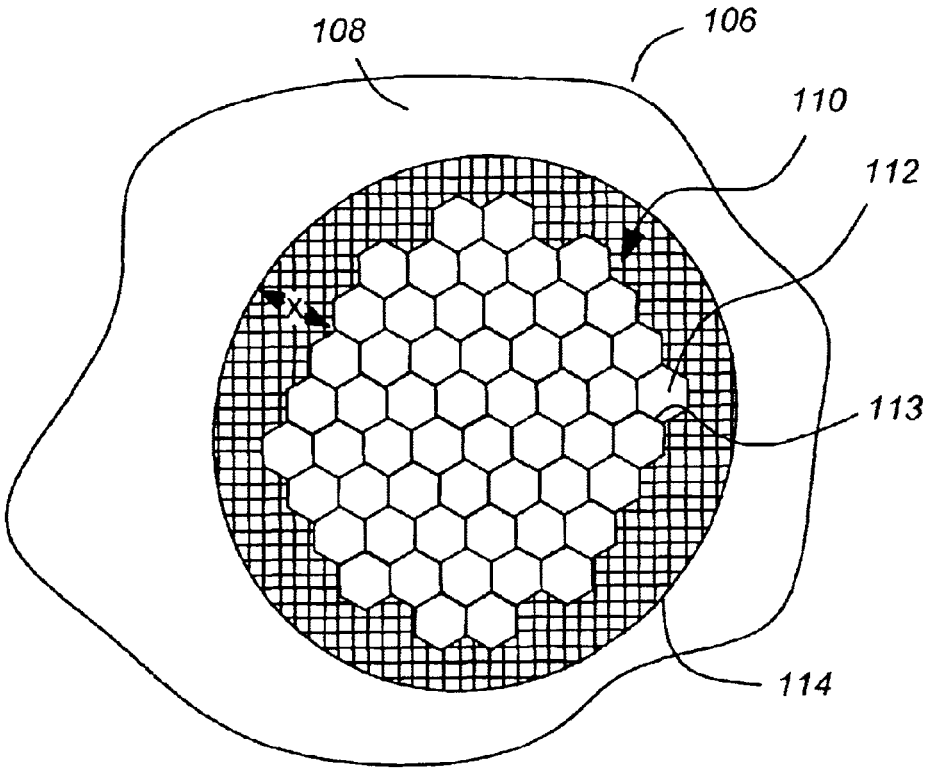
FIG. 1B is a diagram showing a circularly polarized antenna system.
Figure 1C:
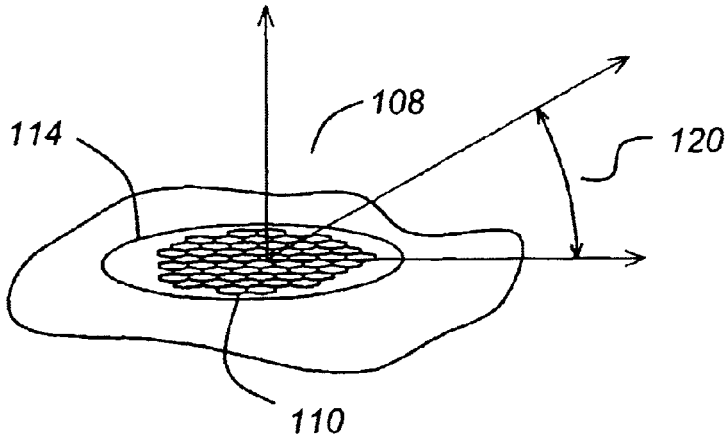
FIG. 1C is a diagram of the circularly polarized antenna system, showing the scan angle.

FIGS. 1B and 1C shows a circularly polarized antenna system 106 comprising a circularly polarized antenna 110 mounted on a high impedance buffer surface 114 that surrounds the circularly polarized antenna 110. The circularly polarized antenna 110 may be a phased array antenna comprised of a plurality of antenna elements 112, or other design. The high impedance buffer surface 114 surrounds the circularly polarized antenna 110 and is disposed between the circularly polarized antenna 110 and a ground plane 108. The ground plane 108 can be formed of any conductive surface. In one embodiment, the ground plane 108 comprises the metallic skin surface of the spacecraft 102A or the aircraft 102B. In another embodiment (applicable, for example, to mechanically steered antennas), the ground plane 108 is a separate structure. The high impedance buffer surface 114 surrounds and extends beyond the circularly polarized antenna 110 at a width x. The width x of the buffer region that is required for sufficient axial ratio improvement depends upon the beam angle of interest, with beam angles that are closer to the ground plane 108 requiring a wider buffer region, because waves propagate closer to the ground plane at such beam angles. A typical width for most beam angles is several wavelengths at the operating frequency of interest.

The high impedance buffer surface 114 passivates the surrounding ground plane 108 so that the horizontal and vertical components of the radiation from the circularly polarized antenna 110 are substantially equal. This results in an improved axial ratio, and a reduction in the interference between left and right hand circular polarization components. This is useful for satellite communication, particularly for phased arrays on airplanes, in while the array is required to steer to point toward the satellite, which, depending on the orientation of the airplane, may at times be at low angles with respect to the ground plane 108. In one embodiment, the high impedance buffer surface 114 is a two-dimensionally periodic structure, as described in Sievenpiper, D., "High Impedance Electromagnetic Surfaces," Ph.D. Dissertation, Department of Electrical Engineering, University of California, Los Angeles, Calif. 1999.

In an embodiment in which the circularly polarized antenna 112 is a phased array 110 (such as that which is illustrated in FIG. 1) with closely packed elements 112, the high impedance buffer region 114 simply surrounds the array 110. However, if there is a region 113 of significant distance (e.g. approximately ⅛ wavelength) between the elements 112 of the array, the region 113 is filled with high-impedance surface (such as is described below) as well. For spaces less than about ⅛ a wavelength, there is insufficient room for enough high impedance material to be inserted while maintaining its high-impedance properties, since a minimum of a single period of the high-impedance material is typically required.

In the typical application shown in FIG. 1A, the aircraft 102B communicates with the spacecraft 102A. As the aircraft 102B maneuvers, the polarization purity of left and right hand circularly polarized waves will be destroyed, since the antenna will be receiving in vertical polarization (with respect to the metal skin of the aircraft 102B). This is because the horizontal polarization is effectively shorted out by the metal ground plane (typically, the aircraft's metal surface). Since vertical polarization comprises both left hand and right hand components, these components cannot be distinguished. Therefore, both polarizations cannot be used simultaneously without interfering with each other. The high-impedance enhanced antenna of the present invention allows polarization purity to be maintained so that both polarizations can be used independently, thus providing two channels of information and potentially doubling available throughput.

Figure 2:
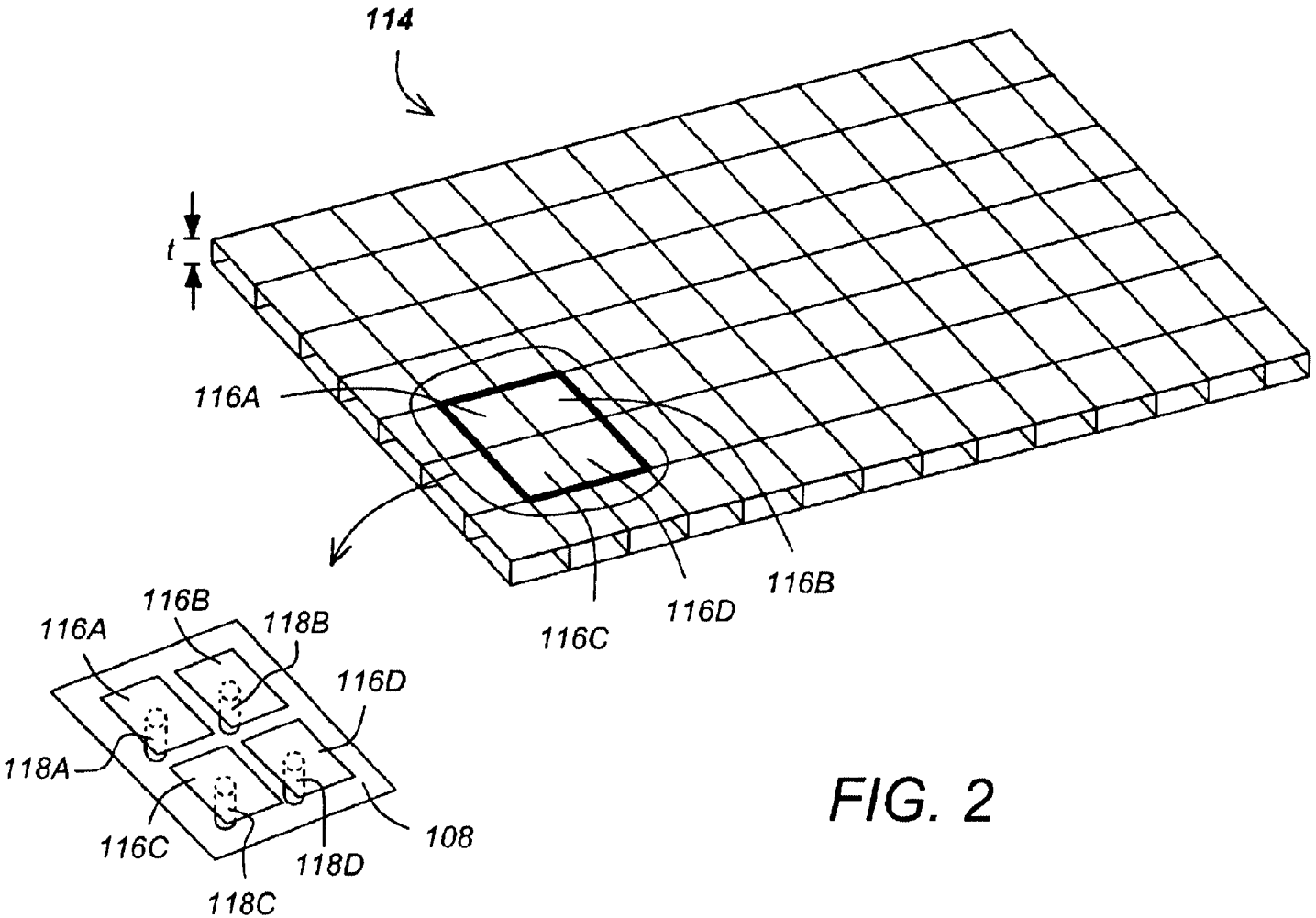
FIG. 2 is a diagram presenting an illustration of one embodiment of the high impedance surface.

FIG. 2 is a diagram presenting an illustration of one embodiment of the high-impedance 114. In this embodiment, the high-impedance surface 114 is designed for Ku-band (12–18 GHz) operation.

The resonance frequency and bandwidth of the surface are determined by the inherent sheet capacitance C and sheet inductance L, which are determined by the geometry of the structure of the high-impedance surface 114. Such surfaces can be manufactured as a printed circuit board with embedded capacitors, whose value and arrangement determines the overall sheet capacitance. The sheet inductance is determined by the thickness of the structure t and by the magnetic permeability $\mu$ of the material that fills it. Since magnetic materials are typically not effective at high frequencies, and also tend to be lossy, the sheet inductance is essentially determined by the thickness t. In the illustrated example, the built-in capacitors are of the edge-coupled type, but parallel-plate capacitors can also be used for greater sheet capacitance, for lower frequency structures. The resonance frequency ω is determined by the parallel resonant circuit defined by the sheet capacitance and the sheet inductance, and the bandwidth $$\frac{\Delta\omega}{\omega_0}$$

is determined by the intrinsic impedance of the surface compared to the impedance of free space. These relationships are defined according to Equations (1)–(4) below:

$$C = \frac{w(\varepsilon_1 + \varepsilon_2)}{\pi}\cosh^{-1}\left(\frac{a}{g}\right); \quad \text{Equation (1)}$$

$$L = \mu t; \quad \text{Equation (2)}$$

$$\omega = \frac{1}{\sqrt{LC}}; \quad \text{Equation (3)}$$

$$\frac{\Delta\omega}{\omega_0} = \frac{\sqrt{\frac{L}{C}}}{\sqrt{\frac{\mu_0}{\varepsilon_0}}}; \quad \text{Equation (4)}$$

wherein a is a lattice constant, g is a width of a gap between capacitive elements on the substrate, w is a width of each of the capacitive elements, t is a thickness of the substrate, $\epsilon_0$ is the free-space permittivity constant, $\epsilon_1$ is the permittivity constant of the substrate and $\epsilon_2$ is the permittivity constant of the material covering the high impedance high impedance surface, typically air or free space, $\mu_0$ is the free-space permeability constant, $\mu$ is the permeability constant of the substrate, and Δω is the bandwidth around a center frequency $\omega_0$.

For a system operating in the Ku band, the surface may be constructed of 62 mil thick DUROID 5880, available from the ROGERS CORPORATION. The metal plates 116A–116D that form the capacitors are arranged in a 145 mil lattice, with a 20 mil gap between them. Each of the plates 116A–116D has a metal plated via 118A–118D that connects the center of the plate 116A–116D to ground plane 108. In the illustrated example, the lattice spacing is 145 mils, so antenna arrays having gaps between the elements of more than 145 mils will have sufficient space to fill those gaps with at least one period of high impedance material. For more closely-spaced arrays, less than one period of the high-impedance material would fit between the antenna elements, so the area surrounding the array should be covered by a high impedance surface. Such a surface can also be used with single antennas, in addition to phased arrays, when low axial ratio over a broad angular range is important. Further details regarding the design of the high-impedance region 114 can be found in D. Sievenpiper, J. Schaffner, and J. Navarro, "Axial Ratio Improvement in Aperture Antennas Using High-Impedance Ground Plane", Electronics Letters, Nov. 7, 2002, Vol. 38, No 23, pp. 1411–1412, which is hereby incorporated by reference herein.

The high-impedance surface 114 can be characterized by measuring surface wave transmission characteristics as well as the reflection phase.

Figure 3A:
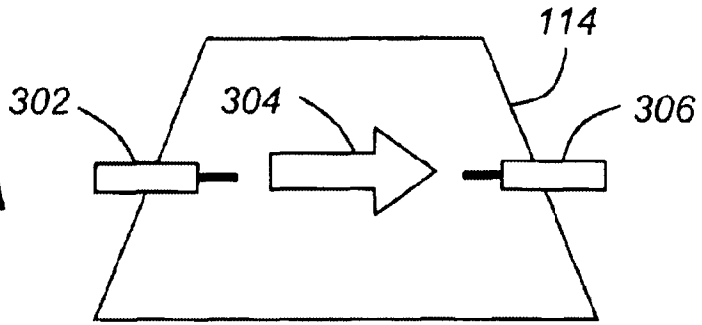
FIGS. 3A through 3C depict the transmission of a surface wave across the high impedance surface.
Figure 3B:
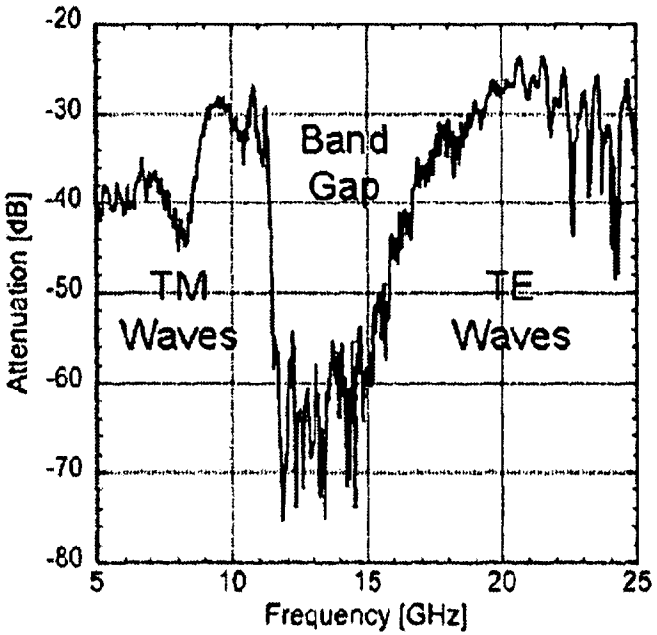
Figure 3C:
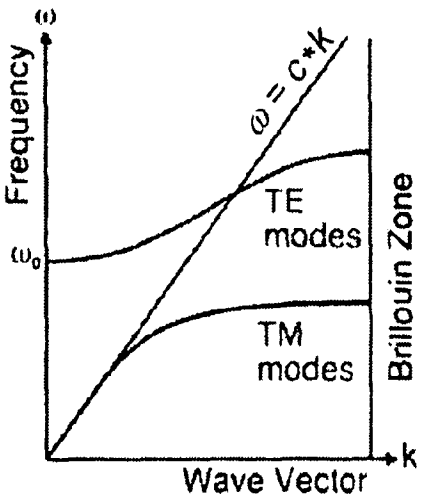

FIGS. 3A and 3B depict the transmission of a surface wave across a high-impedance surface. A first coaxial probe 302 and a second coaxial probe 306, are brought in contact with the high-impedance surface 114. As shown in FIG. 3A, surface waves 304 are launched from the first probe 302 and received by the second probe 306. FIG. 3B illustrates the resulting transmission magnitude, and FIG. 3C depicts a dispersion diagram for a high-impedance surface 114. The wave vector, k is the spatial period of the wave. It is equal to $2\pi\lambda$, where $\lambda$ is the wavelength of the wave. Higher values for k correspond to shorter wavelengths.

The surface 114 supports TM modes below the band gap, and TE modes above the band gap. Within the band gap, and neither type of mode is supported. For the TM modes, the band edge represents a hard cut-off, but leaky TE waves are supported within the gap, and are increasingly bound to the surface at the band edge, so the upper TE band edge is less distinct.

For the exemplary structure shown in FIG. 2, the TM band edge is near 11.5 GHz, and the TE band edge is near 19 GHz. The TE edge is harder to define using this measurement, and it is usually taken to be the point where the TE dispersion curve crosses the light line ((also referred to as the "radiation line" or "radiation cone") defined by $\omega=c*k$ (wherein c is the speed of light) as shown in FIG. 3C, which is where the TE waves become bound to the surface 114.

Figure 4B:
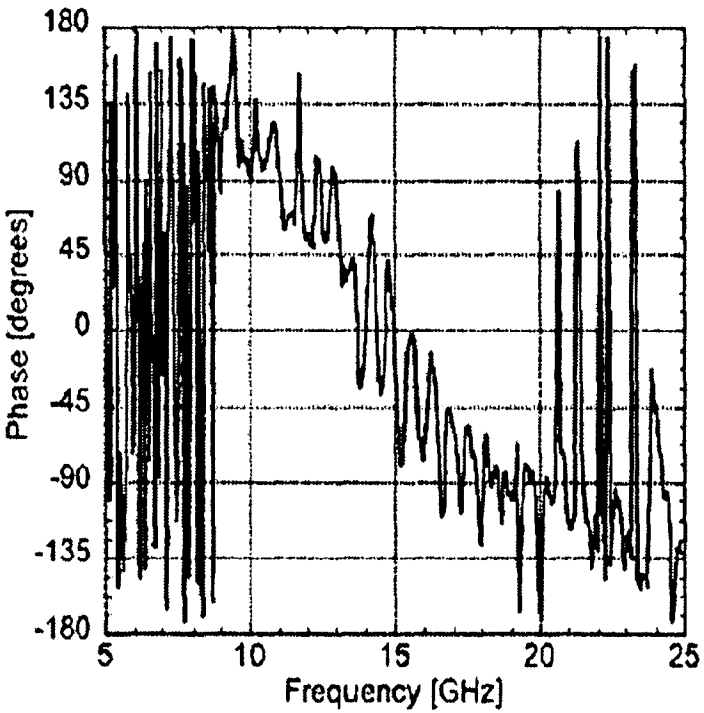
FIGS. 4A and 4B depict the reflection phase of the high impedance surface.
Figure 4A:
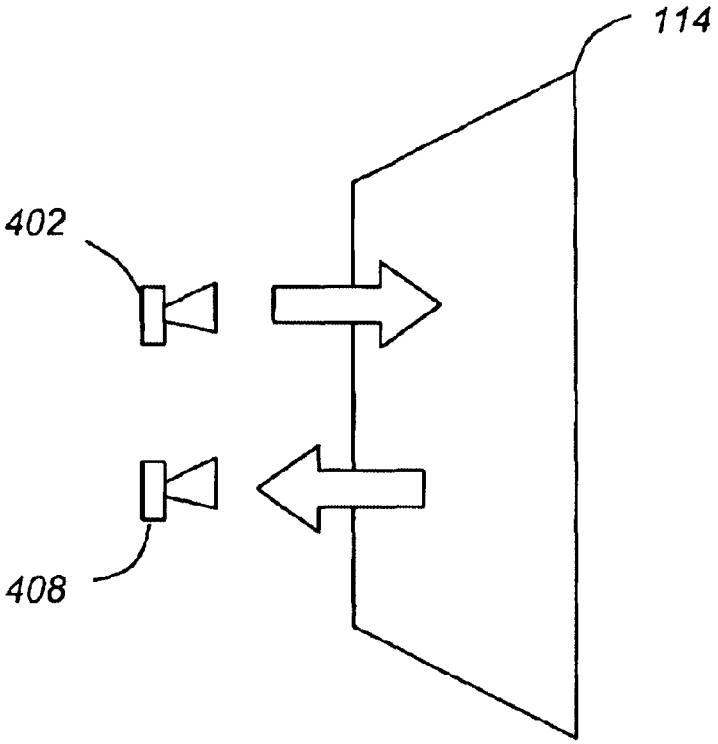

FIG. 4A and 4B depict the reflection phase of the surface 114. As shown in FIG. 4A, a first Ku-band horn 402 and a second Ku-band horn 404, each operating over a frequency range of 12–18 GHz are used to transmit energy and receive energy reflected from the surface 114. As shown in FIG. 4B, the reflection phase passes from 90 to −90 degrees from one band edge (12 GHz) to the other (18 GHz). The resonance frequency $\omega$ is where the reflection phase passes through 0 degrees. Far from resonance, e.g. outside the band gap, the reflection phase is 180 degrees (or −180 degrees). The results shown in FIG. 4B depict a significant amount of noise due to unwanted coupling between the horn antennas 402 and 404, and also due to reflections from other objects in the surrounding area. At the low end of the plot, there is additional noise because the waveguides that feed the horns are operating below cutoff, so negligible signal is transmitted or received. At the upper end of the frequency range, additional noise is also seen because of multiple modes within the waveguide.

Figure 5B:
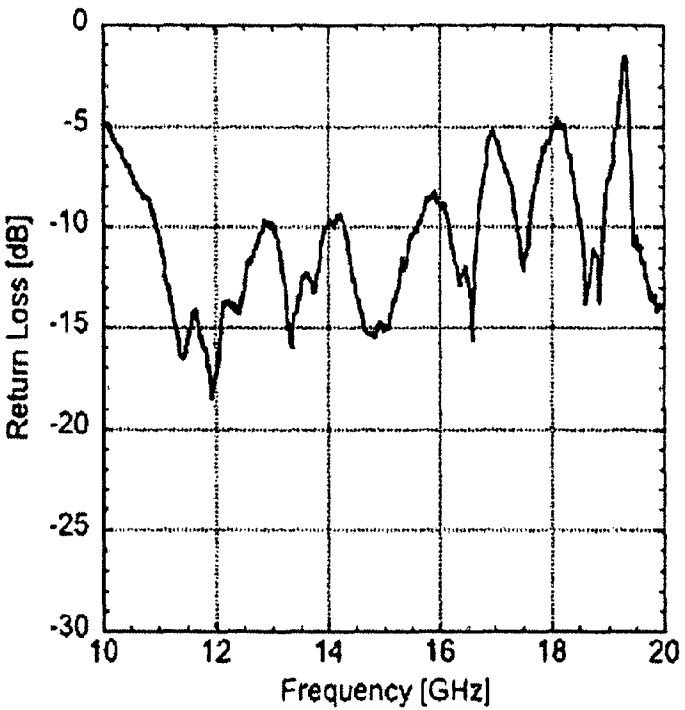
FIG. 5B is a diagram showing the return loss of the structure shown in FIG. 5A.
Figure 5A:
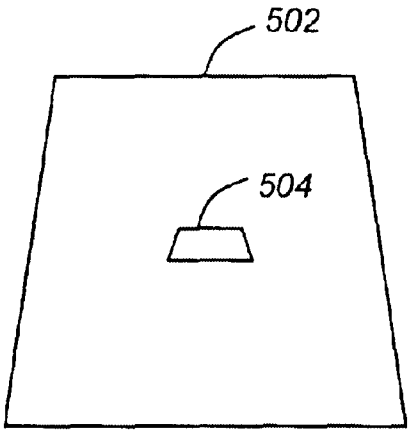
FIG. 5A is a diagram showing a simple aperture antenna and a metal ground plane.

FIG. 5A is a diagram showing a simple aperture antenna having a small aperture 504 in a metal ground plane 502 that matches a standard Ku-band rectangular waveguide fed by a coax-to-waveguide transition. FIG. 5B is a diagram showing the return loss of the structure shown in FIG. 5A.

Figure 6B:
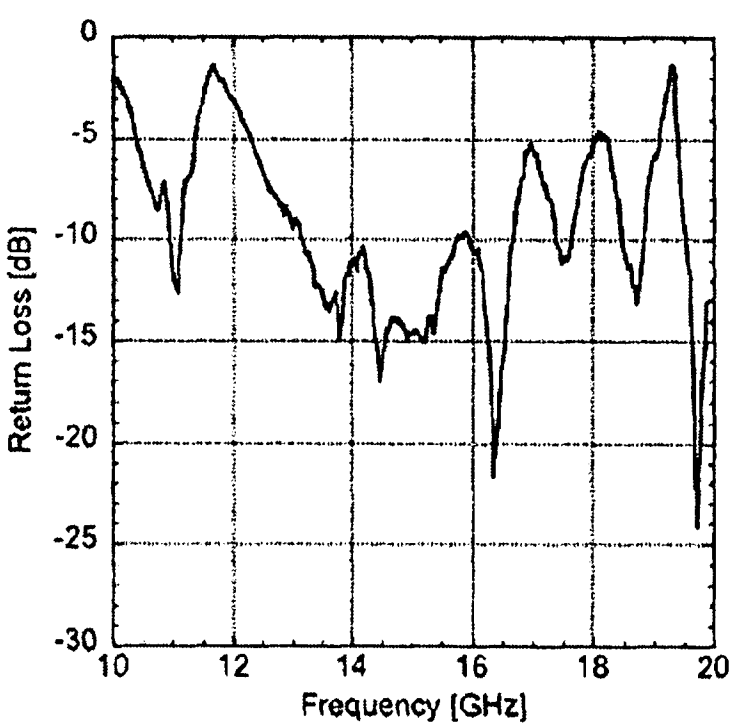
FIG. 6B is a diagram showing the return loss of the structure shown in FIG. 6A.
Figure 6A:
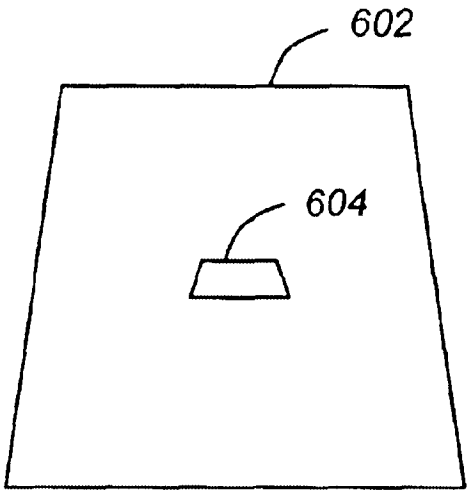
FIG. 6A is a diagram showing a simple aperture antenna and a high intensity surface.

FIG. 6A is a diagram showing a simple aperture antenna having a small aperture 604 in a high-impedance surface 602 such as surface 114. FIG. 6B is a diagram showing the return loss of the structure shown in FIG. 6A. Over the operating band of the high-impedance surface (12–18 GHz) both antennas (FIG. 5A and 5B) appear to be well-matched.

Below the band gap, the high-impedance surface 604 supports a high density of TM surface modes, so it does not enable an antenna with a desirable radiation pattern. This is because these surface waves propagate across the ground plane and radiate from edges and other discontinuities, interfering with the direct radiation from the antenna. However, inside the band gap, the high impedance surface 604 supports neither TM nor TE surface waves, so the radiation pattern is not determined by the shape of the surface. Furthermore, at the resonance frequency $\omega$, the high-impedance surface 604 supports a standing non-propagating wave that radiates normal to the surface 604. Thus, the electric field is spread over a finite region around the aperture 602, and is oriented tangentially to the surface 604. It is this field, and the field at the aperture that determine the radiation pattern of the antenna. On the other hand, the metal surface 502 supports TM surface waves at all frequencies, and shorts TE surface waves at all frequencies. The electric field has no tangential component on a metal surface 602, so the field is only present at the aperture 604. The radiation pattern from an aperture 504 on a metal surface is determined by the aperture 504 and the shape of the ground plane 502.

Figure 7B:
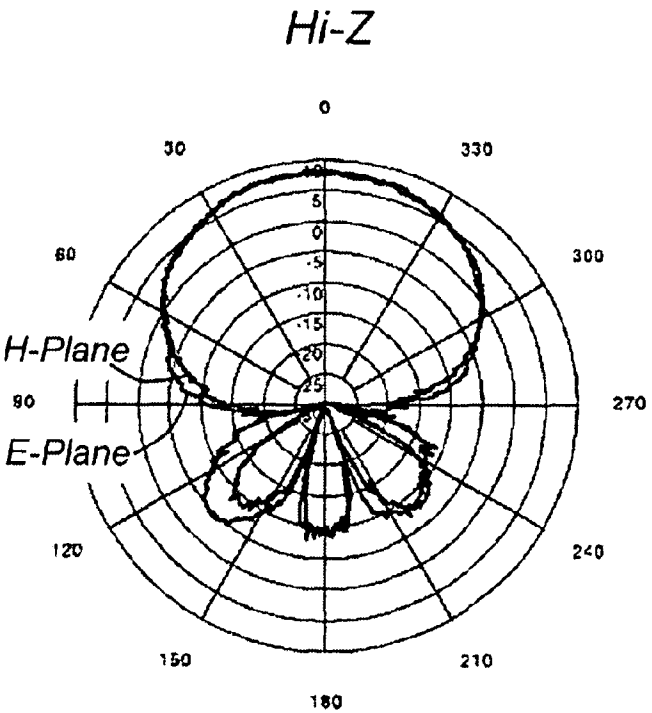
FIG. 7B is a diagram illustrating E-plane and H-plane antenna patters for the antenna shown in FIG. 6A.
Figure 7A:
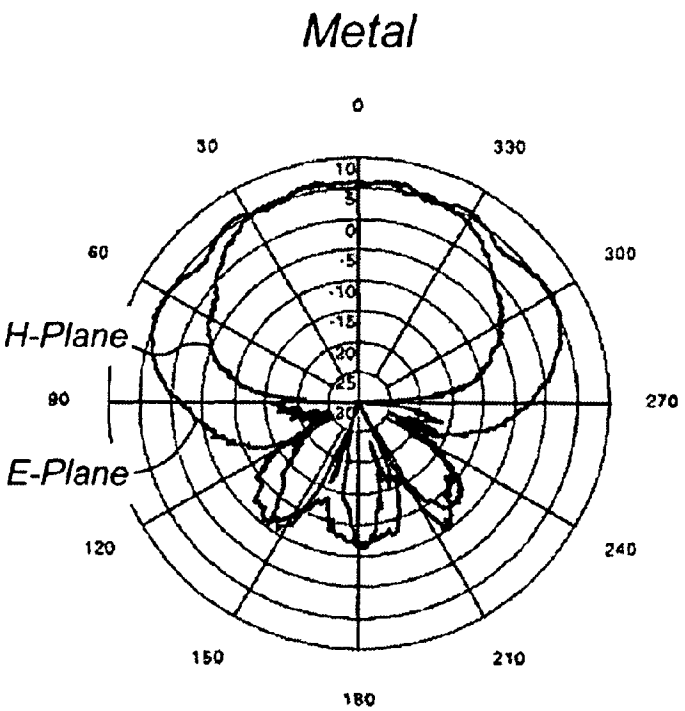
FIG. 7A is a diagram illustrating E-plane and H-plane antenna patters for the antenna shown in FIG. 5A.

FIG. 7A is a diagram illustrating E-plane and H-plane antenna patterns for the antenna shown in FIG. 5A at the resonance frequency of the high impedance surface.

FIG. 7B is a diagram illustrating E-plane and H-plane antenna patterns for the antenna shown in FIG. 6A at the resonance frequency of the high-impedance surface (13 GHz).

It is noted that the metal ground plane 502 produces a pattern that is broad in the E-plane, but narrow in the H-plane. This can be attributed to the fact that for low angles 120, horizontally polarized radiation is shorted by the ground plane 502, resulting in a narrowing of the H-plane pattern, but vertically polarized radiation is not shorted, resulting in a broader E-plane. From another point of view, the metal ground plane 502 supports TM waves, but not TE waves. The high-impedance ground plane 602 supports neither type of wave at this frequency, and thus has a symmetrical pattern. The gain is also slightly higher, due to the tangential, non-propagating mode that surrounds the aperture 604.

Figure 8B:
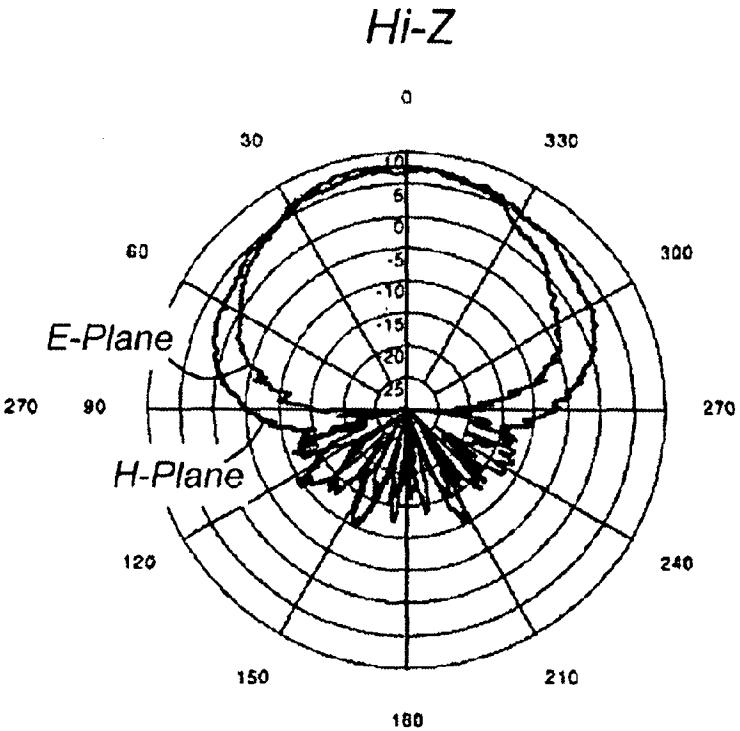
FIGS. 8A and 8B are radiation patterns for the antennas shown in FIGS. 5A and 6A.
Figure 8A:
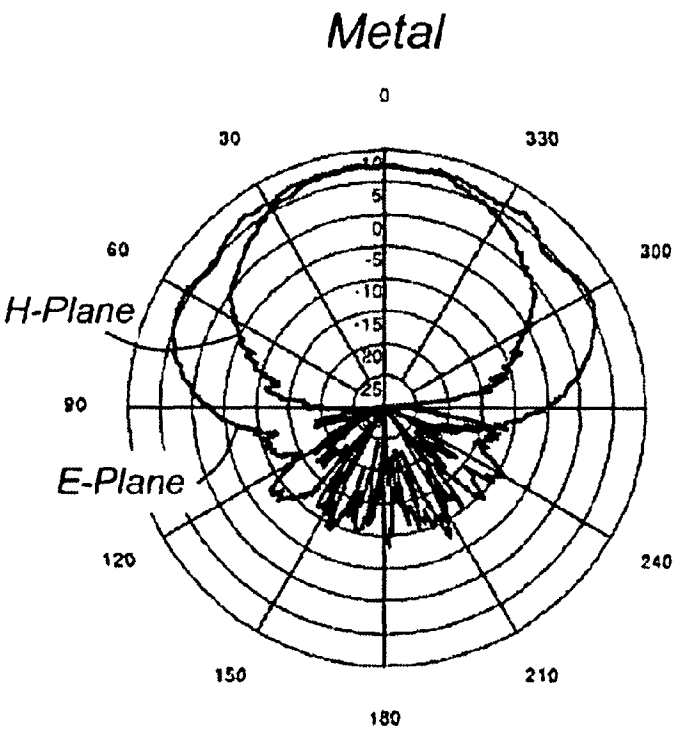

At higher frequencies, that are still within the bandgap, the high-impedance surface 602 begins to support leaky TE waves. This is apparent in the radiation patterns shown in FIGS. 8A and 8B, which include patterns for both the metal 502 and high-impedance surfaces 602 at 17 GHz. The metal surface 502 behaves similarly at both 13 and 17 GHz, but since the high-impedance surface 602 supports leaky TE waves, it allows more radiation to propagate at lower angles in the H-plane, leading to a broadening of the pattern in that plane. The high-impedance surface 602 may be described as an artificial magnetic conductor, and the usefulness of this notion for understanding the surface properties can be seen in the fact that an aperture antenna built using such a surface has a pattern that is nearly opposite to that on the metal surface at this frequency.

Figure 9B:
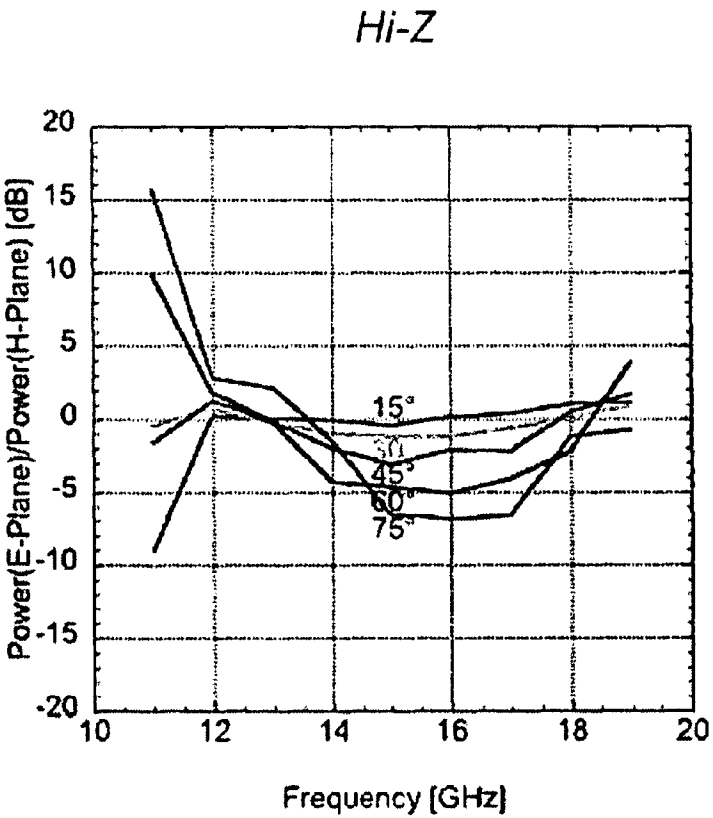
FIGS. 9A and 9B are plots showing the improvement in pattern symmetry that is made possible by the high-impedance surface.
Figure 9A:
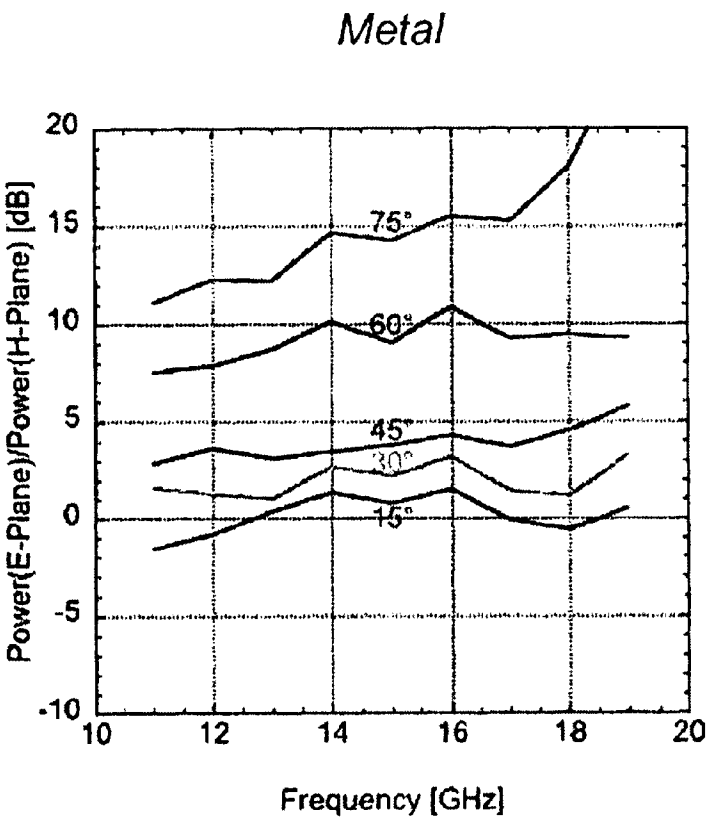

Over a broad range of frequencies and angles, the high-impedance surface 602 produces a pattern that is much more symmetrical than the metal surface 502, regardless of the leaky TE waves. Since these waves always have a significant wave vector in the normal direction (and thus are leaky) they radiate away from the surface 602 much faster than TM waves on an ordinary metal surface 502, which requires no such component. The improvement in pattern symmetry can be seen in FIGS. 9A and 9B, which show the ratio of power in the E-plane over power in the H-plane versus frequency, plotted by beam angle, for both the metal surface 502 and the high-impedance surface 602. Within the bandgap region, the power in both the E and the H-plane is much more nearly equal at every angle.

One notable data point is at 60 degrees, where the metal surface 502 has an axial ratio of about 10 dB, but the high-impedance surface 602 has an axial ratio ranging from 0 to 5 dB, representing an improvement of 5–10 dB. Similar improvements can be seen at other angles.

CONCLUSION

This concludes the description of the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A circularly polarized antenna system, comprising:

a circularly-polarized antenna having a first area;

a high-impedance buffer surface, disposed between the circularly polarized antenna and a ground plane, wherein a surface area of the high-impedance buffer surface area is greater than the first area such that a border area of the high-impedance buffer surface surrounds the circularly-polarized antenna; and wherein a width of the border area of the high-impedance buffer surface is selected to achieve an H-plane radiation pattern substantially identical to an E-plane radiation pattern over a desired scan angle.

2. The antenna system of claim 1, wherein the ground plane is a metallic ground plane.

3. The antenna system of claim 1, wherein the width x of the high-impedance buffer surface is in the order of several wavelengths of the energy emitted by the circularly polarized antenna.

4. The antenna system of claim 1, wherein the high impedance buffer surface comprises a substrate having plurality of capacitive elements.

5. The antenna system of claim 4, wherein the capacitive elements are edge coupled.

6. The antenna system of claim 5, wherein the capacitive elements are coupled to a conductive via electrically connecting the capacitive element to the ground plane.

7. The antenna system of claim 4, wherein the width of the high-impedance buffer surface separating the capacitive elements is approximately ⅛ wavelength of the energy emitted by the circularly polarized antenna.

8. The antenna system of claim 1, wherein the high impedance buffer comprises a substrate having:

a sheet capacitance defined according to $$C = \frac{w(\varepsilon_1 + \varepsilon_2)}{\pi}\cosh^{-1}\left(\frac{a}{g}\right);$$

a sheet inductance according to $L=\mu t$;

a resonance frequency according to $$\omega = \frac{1}{\sqrt{LC}};$$

and a bandwidth according to $$\frac{\Delta\omega}{\omega_0} = \frac{\sqrt{\frac{L}{C}}}{\sqrt{\frac{\mu_0}{\varepsilon_0}}};$$

and wherein a is a lattice constant, g is a width of a gap between capacitive elements on the substrate, w is a width of each of the capacitive elements, l is a thickness of the substrate, $\mu_0$ is the free-space permittivity constant, $\epsilon_1$ and $\epsilon_2$ are permittivity constants of the substrate, $\mu_0$ is the free-space permeability constant, $\mu$ is the permeability constant of the substrate, $\Delta w$ is the bandwidth around a center frequency $\omega_0$.

9. The antenna system of claim 8, wherein the bandwidth is the Ku band, and the lattice constant a is approximately 0.145 inches, the gap width g is approximately 0.02 inches, and the substrate thickness t is approximately 0.62 mil.

10. The antenna system of claim 1, wherein:

the circularly polarized antenna comprises a phased array having a plurality of array elements; and each of the array elements are separated by the high-impedance buffer surface.

11. A circularly polarized antenna system, comprising:

a circularly-polarized antenna having a first area;

means for electrically isolating the circularly polarized antenna from a ground plane, wherein a surface area of the means for electrically isolating the circularly polarized antenna is greater than the first area such that a border area of the means for electrically isolating the circularly polarized antenna surrounds the circularly polarized antenna;

wherein a width of the border area of the means for electrically isolating the circularly polarized antenna is selected to achieve an H-plane radiation pattern substantially identical to an E-plane radiation pattern over a desired scan angle.

12. The antenna system of claim 11, wherein the ground plane is a metallic ground plane.

13. The antenna system of claim 11, wherein the width of the means for electrically isolating the circularly polarized antenna front the ground plane is in the order of several wavelengths of the energy emitted by the circularly polarized antenna.

14. The antenna system of claim 11, wherein the means fox electrically isolating the circularly polarized antenna from the ground plane comprises a plurality of capacitive elements.

15. The antenna system of claim 14, wherein the capacitive elements are edge coupled.

16. The antenna system of claim 15, wherein the capacitive elements are coupled to a means for electrically connecting the capacitive element to the ground plane.

17. The antenna system of claim 11, wherein the means for electrically isolating the circularly polarized antenna from a ground plane comprises a high impedance surface on a substrate having:

a sheet capacitance defined according to $$C = \frac{w(\varepsilon_1 + \varepsilon_2)}{\pi}\cosh^{-1}\left(\frac{a}{g}\right);$$

a sheet inductance according to $L=\mu t$;
a resonance frequency according to $$\omega = \frac{1}{\sqrt{LC}};$$

and a bandwidth according to $$\frac{\Delta\omega}{\omega_0} = \frac{\sqrt{\frac{L}{C}}}{\sqrt{\frac{\mu_0}{\varepsilon_0}}};$$

and wherein a is a lattice constant, g is a width of a gap between capacitive elements on the substrate, w is a width of each of the capacitive elements, l is a thickness of the substrate, $\epsilon_0$ is the free-space permittivity constant, $\epsilon_1$ and $\epsilon_2$ are permittivity constants of the substrate, $\mu_0$ is the free-space permeability constant, $\mu$ is the permeability constant of the substrate, $\Delta w$ is the bandwidth around a center frequency $\omega_0$.

18. The antenna system of claim 17, wherein the bandwidth is the Ku band, and the lattice constant a is approximately 0.145 inches, the gap width g is approximately 0.02 inches, and the substrate thickness t is approximately 0.62 mil.

19. The antenna system of claim 11, wherein:

the circularly polarized antenna comprises a phased array having a plurality of array elements; and each of the array elements are separated by the means for electrically isolating the circularly polarized antenna.

20. The antenna system of claim 19, wherein a width of the high-impedance buffer surface separating the element is approximately ⅛ wavelength of the energy emitted by circularly polarized antenna.

* * * * *